United States Patent [19]

Gabbay et al.

[11] Patent Number: 4,920,554

[45] Date of Patent: Apr. 24, 1990

[54] COMPACT TYPE X-RAY EMITTER

[75] Inventors: Emile Gabbay; Jacques Le Guen, both of Paris, France

[73] Assignee: General Electric CGR SA, Paris, France

[21] Appl. No.: 263,898

[22] Filed: Oct. 28, 1988

[30] Foreign Application Priority Data

Oct. 30, 1987 [FR] France ..... 87 15054

[51] Int. Cl.[5] ..... H01J 35/10

[52] U.S. Cl. ..... 378/200; 378/202

[58] Field of Search ..... 378/202, 200

[56] References Cited

U.S. PATENT DOCUMENTS

| | | | |
|---|---|---|---|
| 1,874,478 | 8/1932 | Fayer | 378/202 |
| 1,987,790 | 1/1935 | Mutscheller . | |
| 2,036,096 | 4/1936 | Pieper | 378/202 |
| 2,119,069 | 5/1938 | Bouwers | 378/201 |

FOREIGN PATENT DOCUMENTS

| | | |
|---|---|---|
| 671924 | 12/1929 | France . |
| 709824 | 8/1931 | France . |
| 821710 | 12/1937 | France . |
| 280636 | 11/1927 | United Kingdom . |

OTHER PUBLICATIONS

Patent Abstracts of Japan, vol. 11, No. 7, (E-469) [2454], Jan. 9, 1987.

*Primary Examiner*—Craig E. Church

*Attorney, Agent, or Firm*—Oblon, Spivak, McClelland, Maier & Neustadt

[57] ABSTRACT

An X-ray emitting device of the X-ray unit type is disclosed, the arrangement of which simplifies maintenance problems. The emitting device has a metallic casing containing an X-ray tube and supply means. According to a feature of the invention, the X-ray tube and the supply means are contained in a first and second imperviously sealed chamber, filled with oil.

10 Claims, 2 Drawing Sheets

COMPACT TYPE X-RAY EMITTER

FIELD OF THE INVENTION

The invention concerns an X-ray emitter of the type where an X-ray tube and means to supply this tube with high and low voltage are assembled to form a single unit. The invention particularly concerns means to improve the construction and maintenance of a device of this type.

DESCRIPTION OF THE PRIOR ART

To produce X-ray radiation, X-ray installations especially for medical diagnosis, comprise an X-ray tube and power supplies producing the different voltages needed to make the X-ray tube work. The X-ray tube and the supplies may be arranged in two configurations which differ from one another chiefly in that, in the first configuration, the X-ray tube is separated from the supplies and the electrical connection is achieved by means of high electrical insulation cables whereas, in the second configuration, the X-ray tube and supplies are combined in a single unit, thus preventing the use of high insulation electrical cables. In the first configuration, the X-ray tube is contained in a metallic box called a casing which provides protection against electrical shocks and X-rays. The casing is filled with an electrically insulating fluid, for example oil, in which the X-ray tube is immersed. Secondly, there is a tank, also filled with insulating oil and containing the various supplies, for example:

the high voltage generator which generates the high voltage supply of the X-ray tube and has, for example, a voltage step-up transformer, the primary winding of which is connected to an AC low voltage source, and in which the secondary winding, which generally has a mid-point at the ground, gives an AC high voltage. The AC high voltage may be applied to a voltage rectifying or multiplying device, also placed in the tank and delivering the high voltage positive and negative polarities, respectively designed to be applied to the anode and the cathode of the X-ray tube:

the tank further contains one or more insulation transformers, designed to give AC low voltage to supply the filament or filaments of the cathode and, in the case of a rotating anode, means to supply the motor used to make the anode rotate.

The high and low supply voltages of the X-ray tube are conveyed from inside the tank to the inside of the casing, by means of two high electrical insulation cables, the first cable conveying the negative high voltage and the low voltage to supply the filament or filaments on the cathode side and the second cable conveying the positive high voltage and the low voltage to supply the anode motor on the anode side. It must be pointed out that, in an X-ray diagnosis installation, the X-ray set is a particularly mobile element and the high electrical insulation cable or cables attached to it are particularly cumbersome because of their high mechanical rigidity needed to obtain the requisite electrical insulation qualities. On this point, it may be noted that, a relatively high voltage supply to an X-ray tube is rarely of the monopole type, solely because of the excessive mechanical rigidity which the high insulating cable should have.

In order to protect users against electrical shocks, one concern of radiological installation builders is to see to it that all the external surfaces of the casing are metallic and are carried to the potential of the ground and that there is electrical continuuity all along this casing, all along the electrical high insulation cable or cables, and all along the tank containing the generator. The electrical high insulation cables are encased in a metallic coat and all arrangements are made so that, throughout the set (and after the connection of the high electric insulation cables) no non-metallic part can be accidentally reached from the outside. However, an exception is made for an output window, formed in the protective casing, through which the useful beam, namely the X-rays used to make an X-ray image, go out.

In the case of the X-ray unit, i.e. in the example of the second configuration, the X-ray emitter has a metallic chamber so that it is isopotential too, like the protective casing of the X-ray set in the first configuration. This metallic chamber or casing is filled with an electrically insulating oil and contains the X-ray tube as well as all the elements needed for its supply such as, for example, those described in the example of the first configuration. The various connections between the X-ray tube and supplies are made inside the casing.

Thus, one of the main advantages of the X-ray unit, as compared with the arrangement described in the first configuration, lies in the fact that it does require no high electrical insulation cables, and in that the cable or cables attached to it are relatively flexible cables conveying low voltage.

However, the X-ray unit has a major drawback with respect to its maintenance, especially in the replacing of an X-ray tube: this operation requires the entire X-ray unit to be returned to the shop. For, replacing an X-ray tube requires action on the connections between the tube and its supplies, after emptying the casing of the oil that it contains. It is then necessary, after replacing the X-ray tube and before making a check on operation, to again fill the casing with insulating oil. This latter operation is particularly difficult especially because the oil should not contain any air bubbles which might harm the electrical insulation. This drawback in the maintenance of the X-ray unit is all the greater as its operation is more intense and results in faster wearing out of the X-ray tube. Thus, for example, in X-ray diagnosis installations of the scanner type which work intensively, the X-ray tube may have to be replaced every three months. Hence, in view of the difficulty in the maintenance of an X-ray unit, some manufacturers prefer to use the arrangement of the first configuration in scanner type installations, despite the drawbacks due to the presence of electrical high insulation cables. These drawbacks are particularly felt in a scanner type instrument where the X-ray unit has to rotate around a patient, sometimes by more than 360°.

The invention concerns an X-ray emitting device of the type forming a single unit which is similar in its external shape to an X-ray unit, but the new arrangement of which enables the prevention of the drawbacks of the latter, especially as regards maintenance.

SUMMARY OF THE INVENTION

According to the invention, an X-ray emitting device comprises a metallic casing, said casing containing an X-ray tube and a power supply means to supply the X-ray tube with high voltage and low voltage, the X-ray tube and supply means being immersed in an electrically insulating fluid, wherein firstly the X-ray tube and, secondly, the supply means are respectively contained in a first and second imperviously sealed chamber and assembled with each other, the two chambers being capable of being separated from each another and having electrical connection means to connect the supply means to the X-ray tube when the two are assembled.

BRIEF DESCRIPTION OF THE DRAWING

The invention will be better understood from the following description, given as a non-exhaustive example, and from the two appended sheets, of which.

DESCRIPTION OF PREFERRED EMBODIMENTS

Figure 1:
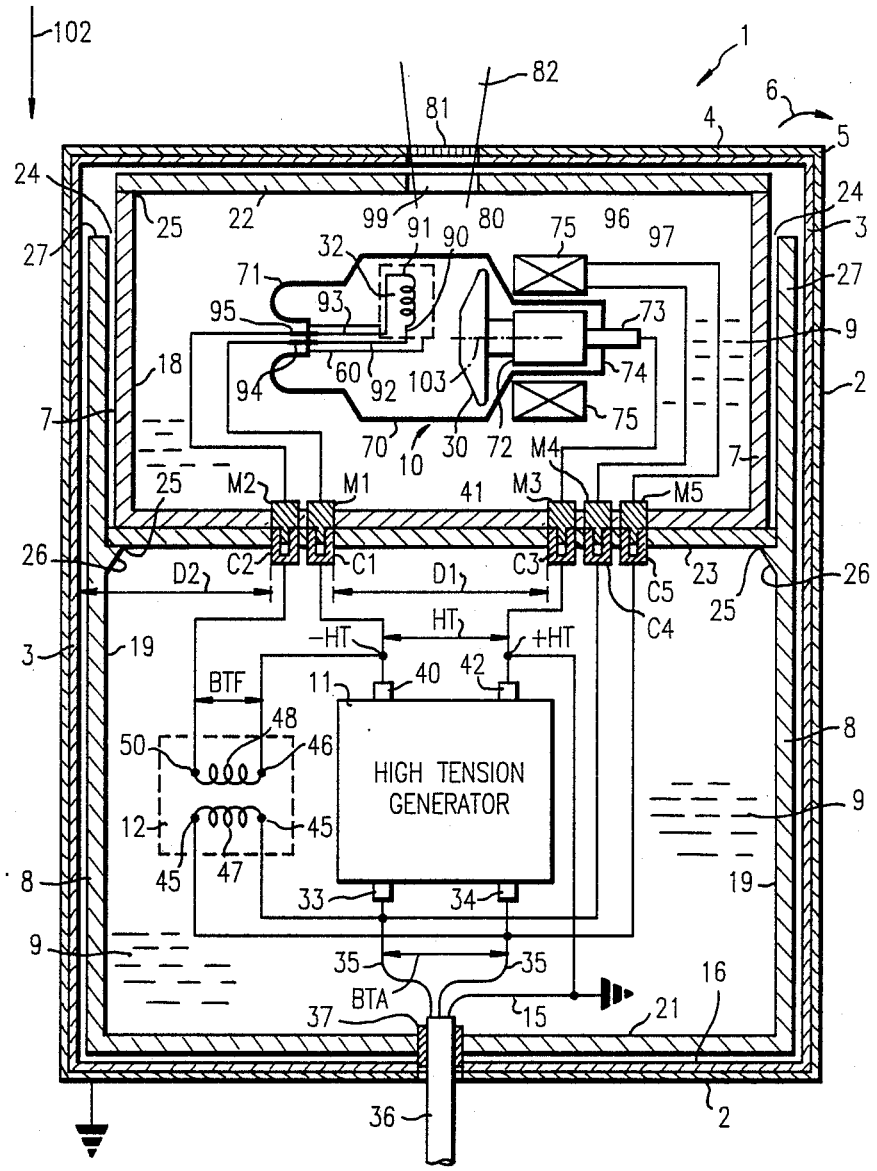
FIG. 1 shows a schematic view of an X-ray emitting device according to the invention.

FIG. 1 gives a non-restrictive exemplary view of an X-ray emitting device 1 according to the invention. The X-ray emitting device 1 has a metallic casing 2, made of aluminum for example. In a first embodiment, the internal walls of the casing 2 are coated with a layer 3 of lead designed to form a protective shield against X-radiation. In the non-restrictive example described, the casing 2 has a substantially cubical shape and forms a box closed by a lid 4. The lid 4 is detachable or, as in the non-restrictive example described, mounted on a hinge 5 which forms one piece with the casing 2 so that it can be lifted by rotation around the hinge 5, as indicated by an arrow 6 in order to enable access to the inside of the casing 2.

According to a feature of the invention, the casing 2 contains a first and second chamber 7, 8, each being imperviously sealed and filled with an electrically insulating oil 9, the first casing containing an X-ray tube 10 and the second casing containing the power supplies 11, 12, needed to provide the supply voltages for the X-ray tube 10. In the non-restrictive example described, these supplies consist, firstly, of a standard type high voltage generator 11 producing a rectified high voltage HT intended to be applied between an anode 30 and a cathode 31 of the X-ray tube 10 and, secondly, of an insulating transformer 12 giving a low voltage BTF, intended to be applied to a filament 32 of the cathode 31.

The two chambers 7, 8, are applied against each another in order to facilitate the electrical connections between these two chambers 7, 8, by means used to separate them easily from each other. In FIG. 1, to distinguish more clearly among the casing 2, the layer of lead 3 and the two chambers 7, 8, which are shown in this FIG. 1 in a sectional view, namely, by their walls, these walls have different hachured patterns.

The two chambers 7, 8, are made of an electrically insulating material which, in a first embodiment of the invention, is a material which is standard per se, such as, for example, epoxy resin.

The first and second chamber 7, 8, respectively have first and second side walls 18, 19, of which only the two walls perpendicular to the plane of the figure are shown. These chambers 7 and 8 also respectively have a first and second bottom plate 20, 21 as well as a first and second top plate 22, 23. The first top plate 22 forms a lid of the first chamber 7 and the second top plate 23 forms a lid of the second chamber 8. For the two chambers 7, 8, their side walls and back plates 18, 20 and 19, 21 respectively, can be formed by one and the same part, by molding for example. The first top plate 22 of the first chamber 7 is fixed to the first walls 18 by standard means (not shown) using seals 25, so that the first chamber 7 is imperviously sealed. The second top plate 23 imperviously seals the second chamber 8, also by means of seals 25. In the non-exhaustive example described, the second top plate 23 is fixed to inner shoulders 26 with which the second walls 19 are provided, so as to facilitate the making of the partitions 27 which extend the second walls 19 and go beyond the second top plate 23 forming, between them, a housing 24 in which the first chamber 7 is placed.

In the non-exhaustive example described, the second chamber 8 is placed on the bottom 16 of the casing 2, and the first chamber 7 is on the lid 4 side of the casing 2, supported on its back plate 20 on the second top plate 23 of the second chamber 8.

The high voltage generator 11 is powered by an AC low voltage supply BTA conveyed in the second chamber 8 by a low voltage cable 36. The low voltage cable 36 goes through the casing 2 and penetrates the second chamber 8 by an imperviously sealed lead-in 37. The low voltage cable 36 is itself connected, outside of the casing 2, to a standard low voltage supply source (not shown) as formed, for example, by electrical network at 50 or 60 hertz. The low voltage cable 36 has two wires 35 carrying the low supply voltage BTA. These wires are applied to input terminals 33, 34 of the high voltage generator 11. A third wire 15 of the low voltage cable 36 carries the ground potential. The high voltage generator 11 gives the negative polarity −HT of voltage through a first output terminal 40 and gives the positive polarity +HT through a second output terminal 42. In the non-restrictive example of the description, the high voltage supply of the X-ray tube 10 is of the monopole type, and the second output terminal 42 is connected to the third wire 15 of the low voltage cable 36, so that the positive polarity +HT is carried to the potential of the ground, the casing 2 being also at the ground potential. Of course, without going beyond the scope of the invention, the high voltage supply could be different depending on the configurations which are known per se to those skilled in the art. These are, for example, monopole supplies with the negative polarity of the high voltage −HT at the ground or, again, according to a symmetrical assembly (not shown) where the negative and positive polarities −HT, +HT of the high voltage are respectively negative and positive with respect to the ground.

According to one feature of the invention, the different voltages needed for the operation of the X-ray tube 10 are conveyed from the second chamber 8 to the first chamber 7 by means of additional connectors with which these chambers are fitted. Thus, for example, the bottom plate 20 of the first chamber 7 has male connectors M1, M2, . . . M5, and the top plate 23 of the second chamber 8 has the same number of female connectors C1, C2, . . . ,C5. To each male connector, there corresponds a female connector. In the non-restrictive example described, the male and female connectors, M1 to M5 and C1 to C5, are respectively mounted in the bottom plate 20 and the top plate 23, in the direction of the thickness of these plates, if necessary by using standard seals (not shown) so that these connectors get fitted together in a simple way when the bottom plate 20 of the first chamber 7 is supported on the top plate 23 of the second chamber 8. The first chamber 7 is guided by partitions 27. The X-ray tube 10 has a jacket 70 which is vacuum sealed in a standard way. The jacket 70 contains the cathode 31 borne by a support 60 at a first end 71 of the jacket 70 and placed so as to face the anode 30. In the non-restrictive example described, the anode 30 is a rotating anode solidly joined to a rotor 72 by means of a metallic supporting shaft 77. The rotor 72 is itself borne by a metallic supporting shaft 73 which is fixed to a second end 74 of the jacket 70. The rotor 72 works in cooperation, in a standard way, with a stator 75 located outside the jacket 70. In the non-restrictive example described, the jacket 70 is entirely made of an insulating material, which may be glass or ceramic for example, but it may also be metallic on the side of its second end 74, especially when the high voltage supply is of the monopole type with the anodes 30 at the ground potential.

During operation, the cathode 30 produces, with the filament 32, a beam of electrons (not shown) which bombards the anode 30 and forms a focus 80 on this anode 30 which forms the source of an X-radiation. The X-radiation leaves the casing 2 by a window 81, in the form of a useful beam 82. Of course, the layer of lead 3 does not extend beyond the outlet window 81.

In the non-restrictive example shown in FIG. 1, and for the greater clarity of this figure, the cathode 32 is shown in a simplified way by a rectangle containing only the filament 32. However, the cathode 31 may contain several filaments without in any way going beyond the scope of the invention. Each additional filament requires only one additional electrical link since, generally, each filament has one end connected to the cathode itself. Thus, it is enough to have only two electrical connections, to both supply the filament 32 and carry the cathode to the negative polarity of the high voltage: a first and second internal connection 92, 93, connect a first and second end 90, 91 of the filament 32, respectively to a first and second sealed electrical lead-in 94, 95 inserted in the jacket 70 on the first end 71 side of this jacket. The first and second sealed electrical lead-in 94, 95, are respectively connected, inside the first chamber 7, to a first and second male connector M1, M2 which are respectively in contact with a first and second female connector C1, C2. The first female connector C1 is connected, inside the second chamber 8, to the first output 40 of the high voltage generator 11. The connection of the negative polarity −HT with the cathode 31 is thus achieved. The filament 32 is heated by means of the insulating transformer 12 as mentioned earlier. The insulating transformer 12 has a second winding 48 and a primary winding 47 powered by the supply low voltage BTA, i.e. the ends 45 of this primary winding 47 are connected to the wire 35 of the low voltage cable 36. A first end 46 of the secondary winding 48 is connected to the first output terminal 40 of the high voltage generator 11, namely to the negative polarity −HT. A second end 50 of this secondary winding 48 is connected to the second female connector C2 which powers the filament 32.

The second output terminal 42 of the high voltage generator 11, which is at the ground potential and delivers the positive polarity +HT of the high voltage, is connected to a third female connector C3 in which there is engaged a third male connector M3, which is itself connected, inside of the first chamber 7, to the metallic supporting shaft 73: so much so that the positive polarity +HT or ground is applied to the anode 30 by means of the supporting shaft 73, the rotor 72 and a supporting axis 77.

In the non-restrictive example described, where the anode 30 is at the ground, the supply of the stator 75 is done simply by applying the supply low voltage BTA to it, i.e. the inputs 96, 97 of the stator 75 are respectively connected to a fourth and fifth male connector M4, M5. The fourth and fifth male connectors, M4, M5 are respectively engaged in a fourth and fifth female connector C4, C5 which are connected to the wires 35 of the low voltage supply cable 36. In a configuration of this type, since the chambers 7, 8 are electrically insulating, the problems of electrical insulation are restricted to possible electrical sparking between the ground and the negative polarity −HT at the first and second connector M1, C1, M2, C2. These incidents of sparking may occur particularly along the junction 41, between the first bottom plate 20 and the second top plate 23, but they are easily avoided if a distance T1 between these first and second connectors M1, C1, M2, C2 and the third connectors M3, C3 is sufficiently great. Furthermore, the partitions 27 have the effect of increasing of the length of the leakage lines between the negative polarity −HT and the casing 2 which is grounded, but these partitions 27 could be eliminated by placing the first second connectors M1, C1, M2, C2 at a sufficiently great second distance D2 from the casing 2 i.e. a distance which is substantially equal to the first distance Dl. Of course, the supply for the stator 75 can be achieved by any other standard configuration ith, for example, the stator 75 carried to a potential different from that of the rotor 72. It must be noted, furthermore, that within the framework of the invention, the rotor 72 may also be of of the magnetic suspension type; this may possibly affect only the number of electrical connections which have to be set up between the first and second chambers 7, 8.

It must be noted that the new arrangement of the emitting device according to the invention, wherein the X-ray tube is mounted in a chamber 7 filled with insulating oil 9 and wherein the supply means 11, 12 are mounted in a second chamber 8, also filled with insulating oil, may worry the specialist and dissuade him from adopting an approach of this type because it requires two operations for filling with insulating oil whereas only one oil filling operation is needed for an X-ray tube according to the prior art. However, this drawback is largely compensated for by the advantages of this approach, because the two chambers 7, 8, can easily be assembled and electrically connected to each other and can easily be separated from each another. This firstly makes it possible, in particular, to easily replace a faulty X-ray tube on the spot and, secondly, facilitates manufacture by enabling the separate construction and checking of the chamber 7 containing the X-ray tube and chamber 8 containing the supply means.

According to another feature of the invention, the chamber 7, 8, or either of these two chambers is made at least partially of an electrically insulating material charged with a material having a high atomic number. This makes it possible to obtain a material which is both electrically insulating and X-ray absorbent and capable of forming an electrically insulating protective material.

By making the first chamber 7, for example, with a material of this type, the said material can fulfil the function of protective shield against X-rays thus enabling the elimination of the lead layer 3. The result of this, among others, is considerable simplification of the manufacturing process. It must be noted that this further makes it possible to remove the different elements contained in the second chamber 8 from the effect of the X-rays and thus prevent relatively slow but sure degradation, from X-rays, of some of these elements such as for example, polysulphone insulating elements. It must be noted that this latter result, which is made possible by the use of the electrically insulating shield material and by the separation of the X-ray tube 10 and the supplies 11, 12 into two chambers 7, 8, by itself warrants the making, at least partially, of either of the chambers 7, 8, with a material of this type, i.e. even if the lead layer 3 is kept.

The electrically insulating shield material is obtained from an electrically insulating base material, for example an epoxy resin, which is charged with a material having a high atomic number.

These materials of high atomic number may be electrically insulating materials such as, for example, oxides of tungsten, uranium, thorium or even lead such as minimum.

However, these materials with high atomic number may also be electrically conductive materials such as, in particular, bismuth, tungsten, uranium, thorium and lead. For, tests have shown that an epoxy resin charged with up to about 50% of lead or tungsten, firstly keeps electrical insulating properties which are amply adequate for the AC or DC voltages needed for the operation of a standard X-ray tube. Secondly, it has been observed that the epoxy resin thus charged with a material having a high atomic number and having a thickness of 7 to 8 millimetres., absorbs X-radiation substantially in the same way as the layer of lead having a thickness of about 3 millimetres. The material which is both electrically insulating and X-ray absorbent or the electrically insulating shield material can be obtained, for example, by a method similar to the one whose used is known for reinforcing resins with light metals in the form of powder or glass fibers. The electrically insulating shield material keeps its insulating properties for a very wide range of grain sizes of powder of materials with high atomic numbers, with which the base material, for example epoxy resin, should be charged. Specifically, this grain size ranges between 10 and 100 microns.

If the entire first chamber 7 is made of a material which is both electrically insulating and X-ray absorbent, it becomes necessary to provide, in the first top plate 22 of the first chamber 7, for a second window 99 which absorbs little X-radiation. It is also possible to make the first chamber 7, except for the first top plate 22, out of this material, which is both electrically insulating and X-ray absorbent and to preserve a layer of lead 3*a* on the lid 4 of the casing 2.

In the non-restrictive example shown in FIG. 1, the first chamber 7 is joined to the second chamber 8, i.e. it is placed in the housing 24, by a motion symbolized by an arrow 102, which occurs in a direction substantially perpendicular to the axis of rotation 103 of the rotating anode 30. In a configuration of this type, it is simpler to place the stator 75 inside the first chamber 7.

Figure 2:
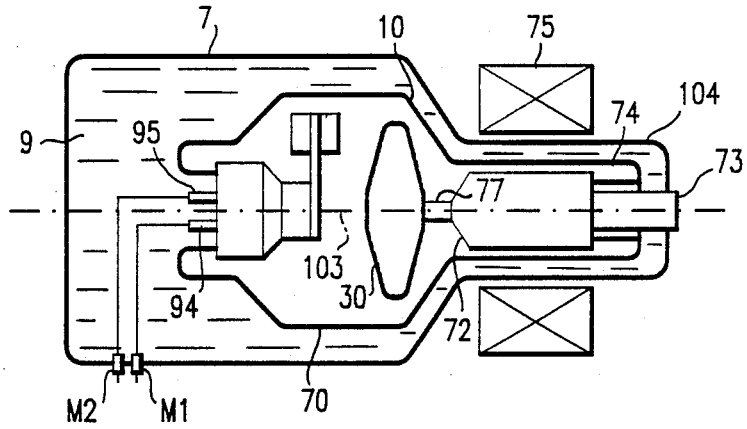
FIG. 2 shows a schematic view of a first chamber shown in FIG. 1, and made as an alternative embodiment of the invention.

FIG. 2 gives a schematic view of an embodiment of the first chamber 7 wherein the chamber 7 differs from the version shown in FIG. 1 inasmuch as, on the second end 74 side of the jacket 70, the chamber substantially fits the shape of this second end 74, i.e. it substantially fits the shape of the rotor 72 and, around the rotor 72, it forms a neck IO4 around which the stator 75 is placed. Since the stator 75 is outside the first chamber 7, it can also be powered directly by the second chamber 8. It must be further pointed out that if the high voltage supply is of the monopole type with the rotor at the ground as described with reference to FIG. 1, the supporting shaft 33 may be extended so as to come out of the first chamber 7 (with the help of seals not shown), so that it is directly connected to the positive polarity +HT or ground without going through the first chamber 7.

Figure 3:
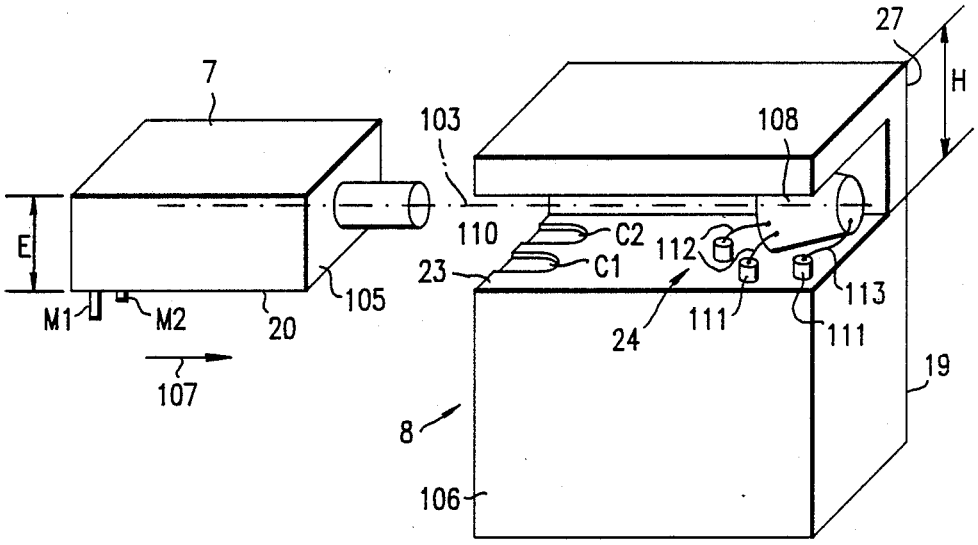
FIG. 3 is a perspective view showing the chamber shown in FIG. 2 and designed to be assembled with a second chamber.

FIG. 3 shows a non-restrictive example, in a perspective view, of the first and second chambers 7, 8, designed to be assembled with each other, in an alternative embodiment of the invention where the stator 75 is outside the first chamber 7. The first chamber 7 is extended, at one end 105, by the above-mentioned neck 104, placed along the rotational axis 103 and containing the rotor 72 (not visible in FIG. 3) . The second chamber 8 consists of main unit 106 containing the supplies 10, 11, (shown in FIG. 1), of which one side wall 19 extended by the partition 27 on a height H substantially corresponding to a thickness E of the first chamber 7. The partition 29 is then curved above the top plate 23 of the second chamber 8 so as to form the housing or cavity 24 designed to take the first chamber 7. The first chamber 7 is inserted in the cavity 24 by a motion which occurs in parallel to the axis of rotation 103, as shown in FIG. 3 by a second arrow 107.

In the non-restrictive example described, the stator 75 (not shown in FIG. 3) is contained in a protective case 108, which is cylindrical or conical for example, fixed in the cavity 24. The case 108 is placed in such a way that the stator 75 is centered in the rotational axis 102, i.e. arranged around the neck 104 and the rotor 72, contained in the latter, when the first chamber 7 is entirely engaged in the cavity 24. The first and second male connectors M1, M2, extend beyond the bottom plate 20 on the first chamber 70 and are placed in contact with the first and second female connectors C1, C2, when the first chamber 7 is entirely engaged in the cavity 24. The female contacts C1, C2 are placed on the top plate 23 of the second chamber 8, at the end of grooves 110 made in the top plate 23 to enable the passage of the connectors M1, M2. In this embodiment of the invention, since the stator 75 is solidly joined to the second chamber 8, its supply can be achieved by means of two simple connection wires 112 which cross the top plate 23 by imperviously sealed lead-in elements 111. The connection with the supporting shaft 73 or, in other words, with the anode 30 of the positive polarity +HT, which also forms the ground in the example, by means of a contact device (not shown) which is standard per se, placed in the shielding case 108 and place in electrical contact with the supporting shaft 73 when the first chamber is entirely engaged in the cavity 24. This contact device is connected to a third connecting wire 113, which penetrates the second chamber 8, in going through the top plane 23 by an imperviously sealed lead-in 111.

In the non-restrictive examples described, where the polarity +HT is at the ground, the protective case 108 may be metallic but it may also be made of an insulating material if the high voltage supply is of a different type and, also, the cavity 24 may be entirely enclosed by an insulating material as in the example of FIG. 1. One of the advantages of the embodiment described with reference to FIG. 3 resides particularly in the fact that it enables reducing the plug-in connectors to the number required for the supply of the cathode and in that it further enables the reduction of the number of elements contained in the first chamber7.

What is claimed is:

1. An X-ray emitting device of the X-ray unit type, comprising:

a metallic casing, said casing containing an X-ray tube and a power supply means to supply the X-ray tube with high voltage and low voltage, said X-ray tube and said supply means are respectively immersed in separate electrically insulating fluids, wherein the X-ray tube and the supply means are respectively contained in first and second imperviously sealed chambers and which are detachable electrically connected with each other, with said two chambers being entirely or partially made of an electrically insulating material.

2. An emitting device according to claim 1, wherein the two chambers are assembled with each other and can be separated from each other, the two chambers comprising electrical connection means to connect the supply means to the X-ray tube when the two chambers are assembled together.

3. An emitting device according to claims 1 or 2, wherein the second chamber comprises a cavity in which the first chamber is place.

4. An emitting device according to claim 3, wherein the cavity is formed between partitions made of and electrically insulating material.

5. An emitting device according to claim 4, wherein the partitions constitute a means for guiding the first chamber.

6. An emitting device according to claim 1, wherein at least one of the two chambers is at least partially made of an electrically insulating material charged with a material having a high atomic number, so as to form a protective shield against a leaked X-radiation emitted by the X-ray tube.

7. An emitting device according to claim 6, wherein the first and second chambers respectively comprise a first and second plate, respectively forming a part of the first chamber and a part of the second chamber, the two plates separating the two chambers, and wherein at least one of the two plates is made of an insulating material charged with a material having a high atomic number so as to form a protective shield, at least for the supplied contained in the second chamber, with respect to the leaked X-radiation emitted by the X-ray tube.

8. An emitting device according to claim 7 wherein the X-ray tube comprises a rotating anode, the rotation of which is achieved by means of a rotor and a stator, the stator being contained in the first chamber.

9. An emitting device according to claim 7, wherein the X-ray tube comprises a rotating anode, the rotation of which is achieved by means of a rotor and a stator, the stator being outside the first chamber.

10. An emitting device according to claim 9, wherein the stator is fixed to the second chamber.

* * * * *